US005687902A

United States Patent [19]

Tusing et al.

[11] Patent Number: 5,687,902

[45] Date of Patent: Nov. 18, 1997

[54] ARTICULABLE, OPEN-TOPPED, STACKABLE, SIDE-OPENING CONTAINER APPARATUS

[75] Inventors: Michael A. Tusing, Canton, Mich.; Robert B. Leftwich, Bolingbrook, Ill.

[73] Assignee: Stone Container Corporation, Chicago, Ill.

[21] Appl. No.: 581,004

[22] Filed: Jan. 3, 1996

Related U.S. Application Data

[63] Continuation of Ser. No. 225,233, Apr. 8, 1994, abandoned.

[51] Int. Cl.[6] ..... B65D 5/20

[52] U.S. Cl. ..... 229/198.1; 229/23 A; 220/684

[58] Field of Search ..... 229/198.1, 23 A, 229/23 AB, 915, 919, 109; 220/433, 682, 683, 684, 685, 7

[56] References Cited

U.S. PATENT DOCUMENTS

| | | | |
|---|---|---|---|
| 752,880 | 2/1904 | Bacon | 220/7 |
| 2,993,637 | 7/1961 | Lacey | 229/198.1 |
| 3,281,049 | 10/1966 | Avitable et al. | 229/23 AB |
| 3,854,269 | 12/1974 | Hancock | 220/683 |
| 3,935,990 | 2/1976 | Crane | 229/915 X |
| 4,078,716 | 3/1978 | Harley et al. | 229/198.1 |
| 4,098,424 | 7/1978 | Liebscher et al. | 220/7 X |
| 4,549,673 | 10/1985 | Kupersmit | 229/23 AB |
| 4,792,084 | 12/1988 | Dreeszen | 229/109 |
| 4,828,132 | 5/1989 | Francis, Jr. et al. | 220/4.33 |
| 5,037,027 | 8/1991 | Nichols | 229/198.1 |
| 5,141,149 | 8/1992 | Fulton | 229/915 X |
| 5,377,857 | 1/1995 | Taravella et al. | 229/198.1 |

*Primary Examiner*—Allan N. Shoap
*Assistant Examiner*—Christopher J. McDonald
*Attorney, Agent, or Firm*—Dick and Harris

[57] ABSTRACT

An articulable, open-topped, stackable, side-opening container apparatus is provided, having at least one bottom wall member, with a plurality of opposed side wall members emanating therefrom. The side wall members are articulable from positions substantially coplanar with, to positions substantially perpendicular to, their respective bottom wall members. Mating engagement members, affixed to edges of the side wall members, which are adjacent when the side wall members are upright, maintain the side wall members upright.

29 Claims, 4 Drawing Sheets

ARTICULABLE, OPEN-TOPPED, STACKABLE, SIDE-OPENING CONTAINER APPARATUS

This application is a continuation of application Ser. No. 08/225,233 filed Apr. 8, 1994, now abandoned.

BACKGROUND OF THE INVENTION

The present invention relates to containers for the containment, protection and transportation of articles, such as food produce articles. In particular, the invention relates to such containers, which may be fabricated from corrugated material.

Typical containers for the containment and transport of food produce articles, for example from the source to the distributor or ultimate market destination, are wooden or corrugated containers having fixed configurations. Often, the containers are partially or completely open-topped. Such containers, while stackable, can be unstable when stacked, and easily toppled, leading to damage to the produce. In addition, wooden cartons can be relatively expensive. While corrugated cartons may be less expensive to produce, typically, they are less ruggedly constructed and thus have shorter useful lifespans. To increase their durability, corrugated boxes are often used which have smaller volumes, to increase the strength-to-size ratio. However, this procedure has the drawback that more boxes are needed, for a given amount of produce articles to be transported.

The cost of labor, in the form of the time required for handling the produce, and the cost of the shipping containers, can be significant factors in the overall cost of the produce. Accordingly, it is desirable to provide a more durable, and easier to manipulate container for the transport of articles such as food produce articles.

For example, while it may be efficient to load a produce container from above, in order to empty the container, the produce must be lifted out, or the container overturned. Lifting produce out of the carton may be time consuming, and overturning cartons may be impractical due to their size, and may also be damaging to the cartons and/or produce as well.

A particular problem arises during the transportation of produce, such as tomatoes, which when ripe or near ripe, are very fragile and subject to bruising or damage. If the produce (like tomatoes) are picked too soon prior to ripeness, the produce is less susceptible to damage, but will not ripen properly or to as high a quality of taste and color, as if allowed to remain unpicked longer.

An attempted solution has been to pick such produce, such as tomatoes, when still unripe and more "durable". The "green" tomatoes are then treated with certain gases to artificially ripen them. This is may be an unacceptable alternative, in that some consider the flavor, color and general quality of such produce to be lower than that of more naturally ripened produce.

Many prior art containers for such produce often were not durable and flexible enough to protect and prevent damage to the produce. In addition, ventilation, which is important for some kinds of produce, is often sacrificed for strength.

Accordingly, it is desirable to provide a container for transporting produce which is both durable, with high strength to prevent failure and damage to the produce, but also has some flexibility and give to its construction, so as to have less tendency to bruise the produce. Likewise it is desirable to provide such a container which permits adequate ventilation for the produce, when desired.

Accordingly, it is an object of the present invention to provide a container which may be articulated to provide access from the side, which may enable more efficient emptying of the container.

It is a further object of the present invention to provide a container which is configured to be stackable in a more secure, stable manner.

A still further object of the present invention to provide a container which is fabricated from corrugated material, having an improved, more rugged construction, and yet a construction which provides greater protection for the produce carried.

These and other objects of the invention will become apparent in light of the present specification, claims and drawings.

SUMMARY OF THE INVENTION

The invention is an articulable container apparatus for containment and protection of articles, in which the container apparatus has an upper opening and further is stackable with other similar container apparatus. The container apparatus comprises at least one bottom wall member. First and second side wall members are operably associated with the at least one bottom wall member, and articulable from positions substantially coplanar with the at least one bottom wall member to positions substantially perpendicular to the at least one bottom wall member. The first and second side wall members are further arranged upon substantially opposite sides of the at least one bottom wall member. Third and fourth side wall members are similarly operably associated with the at least one bottom wall member, and articulable from positions substantially coplanar with the at least one bottom wall member to positions substantially perpendicular to the at least one bottom wall member. In addition, the third and fourth side wall members are further arranged upon substantially opposite sides of the at least one bottom wall member, such that the third and fourth side wall members are arranged in alternating positions relative to the first and second side wall members around the at least one bottom wall member.

A plurality of releasable side wall engagement means are operably associated with at least three of the first, second, third and fourth side wall members, such that upon the articulation of the first and second and third and fourth side wall members into the substantially perpendicular positions relative to the at least one bottom wall member, the at least one bottom wall member, and the first, second, third and fourth side wall members define and partially enclose an article containment region.

The at least one bottom wall member and the first, second, third and fourth side wall members are all fabricated from a first material, and the releasable side wall engagement means are fabricated from at least a second material having a strength greater than the first material, such that the releasable side wall engagement means further serve as reinforcement means for the at least three of the first, second, third and fourth side wall members, whereupon release of a pair of adjacent side wall engagement means at opposite ends of at least one of the first, second, third and fourth side wall members, the side wall member may be articulated from its respective position substantially perpendicular to the at least one bottom wall member to enable access from the respective side to the article containment region.

In a preferred embodiment of the invention, the at least one bottom wall member comprises one bottom wall member, with the first and second side wall members being operably associated with the one bottom wall member, upon opposite sides thereof, and the third and fourth side wall members likewise being operably associated with the one bottom wall member, upon further opposed sides thereof, in alternating positions with the first and second side wall members, such that upon the articulation of the first, second, third and fourth side wall members, the side wall members define and partially enclose the article containment region. The first and second side wall members are formed continuously with the one bottom wall member from a single piece of container material. The third and fourth side wall members are also formed contiguously with the one bottom wall member from a single piece of container material.

In an alternative embodiment of the invention, the at least one bottom wall member comprises a first bottom wall member and a second bottom wall member. The first and second side wall members are operably associated with the first bottom wall member, upon opposite sides thereof, and the third and fourth side wall members ate operably associated with the second bottom wall member, upon opposite sides thereof, the first and second bottom wall members being positionable into juxtaposed, adjacent, parallel overlying relation to each other, to enable the articulation of the first, second, third and fourth side wall members to define and partially enclose the article containment region. The first and second side wall members are formed contiguously with the first bottom wall member from a single piece of container material. The third and fourth side wall members are formed contiguously with the second bottom wall member from a single piece of container material.

Each of the releasable side wall engagement means comprises a pair of engagement members operably arranged upon adjacent edges of adjacent ones of the first, second, third and fourth side wall members, respectively, and arrangeable in juxtaposed cooperating relation to one another, when the side wall members are in the substantially perpendicular positions relative to the at least one bottom wall member; and a removable locking member operably insertable into the engagement members so as to maintain the engagement members in the juxtaposed cooperating relation, to, in turn, maintain the adjacent ones of the first or second, and third or fourth side wall members in the substantially perpendicular positions.

A preferred embodiment of the invention also comprises means for facilitating stacking of at least one the articulable container apparatus upon another of the articulable container apparatus, in a substantially secured, stabilized manner. The means for facilitating stacking of the articulable container apparatus comprises at least one stacking tab member, operably emanating upwardly from at least one of the first, second, third and fourth side wall members, when the side wall members are in the substantially perpendicular positions; and at least one stacking aperture operably disposed in at least one of the first and second bottom wall members, such that when a first articulable container apparatus is stacked above another, second articulable container apparatus, at least one stacking aperture in the first articulable container apparatus receives a stacking tab member emanating from the second articulable container apparatus.

In one embodiment of the invention, the at least one stacking tab member comprises a separate tab element, operably and permanently affixable to one of the first, second, third or fourth side wall members. The at least one stacking tab member is preferably fabricated from plastic material.

At least one shield member, is operably positionable upon the at least one bottom wall member, in operable alignment with the at least one stacking aperture, to facilitate protection of the stacking aperture upon receipt of the at least one stacking tab member. Preferably, the at least one shield member is fabricated from plastic material.

Each of the at least one bottom wall member, and the first, second, third, and fourth side wall members is preferably formed from triple wall corrugated material.

The invention also comprises means for resisting outward buckling of opposite ones of the first, second, third and fourth side wall members, when multiple ones of the container apparatus are stacked atop one another and loaded, which may be a substantially rigid support member, operably supported by, extending transversely between and connecting opposite ones of at least one pair of the first and second, and third and fourth side wall members. Further means for resisting outward buckling of side wall members, may be operably disposed upon an upper edge of at least one of the first, second, third and fourth side wall members.

In a preferred embodiment of the invention, the at least one bottom wall member has a substantially octagonal configuration. Wing members may be operably formed in respective side wall members of at least one corresponding pair of the first and second, and the third and fourth side wall members, the wing members being articulable, when the side wall members are articulated to positions substantially perpendicular to the at least one bottom wall member, from positions substantially coplanar with the respective side wall members, to positions substantially oblique to the respective side wall members, such that the first, second, third and fourth side wall members, and the wing members define and substantially enclose an octagonally shaped region, having a configuration substantially corresponding to the octagonal configuration of the at least one bottom wall member.

DETAILED DESCRIPTION OF THE DRAWINGS

Figure 1:
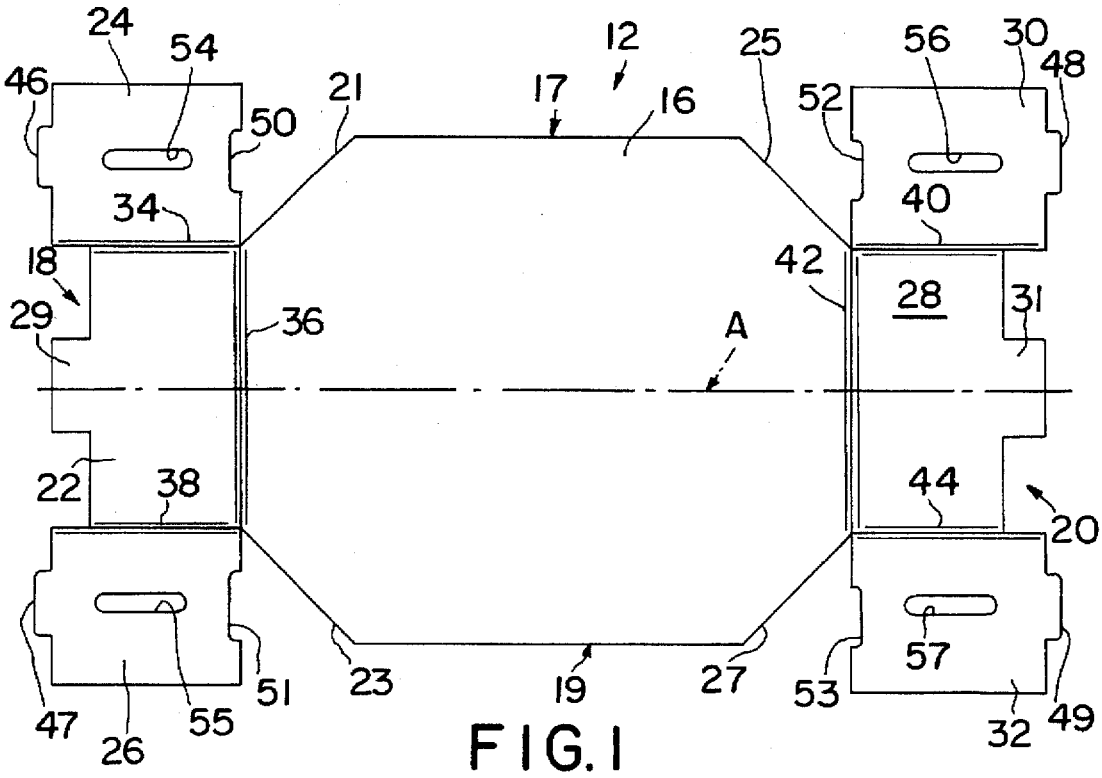
FIG. 1 is a top plan view of the first bottom wall member, and associated side wall members of the articulable container apparatus.

While the present invention is susceptible of embodiment in many different forms, there is shown in the drawings and will be described herein in detail, several specific embodiments, with the understanding that the present disclosure is to be considered as an exemplification of the principles of the invention, and is not intended to limit the invention to the embodiments illustrated.

Figure 2:
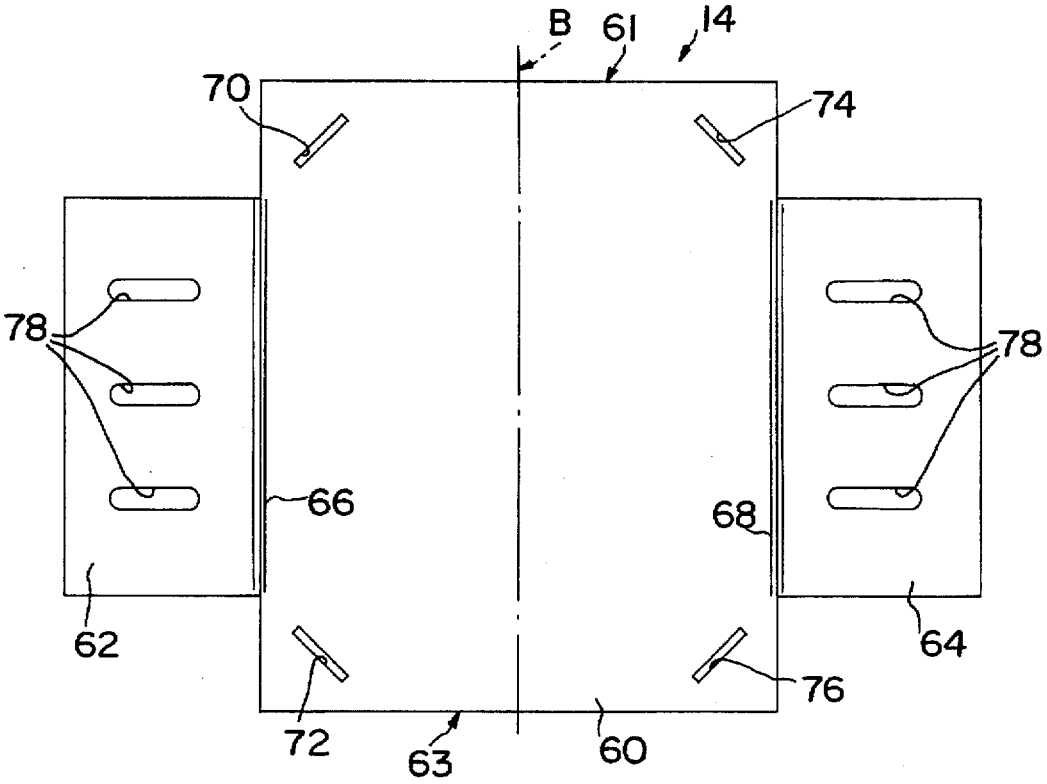
FIG. 2 is a top plan view of the second bottom wall member, and associated side wall members of the articulable container apparatus.
Figure 4:
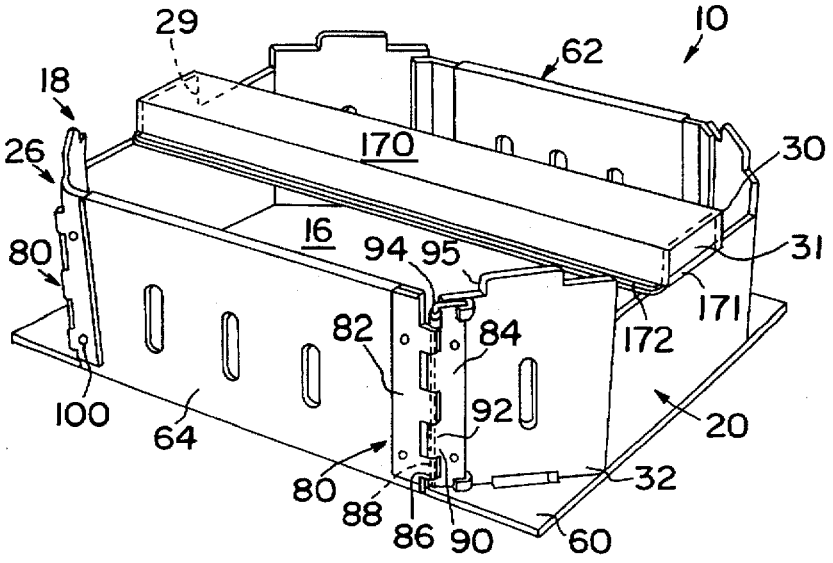
FIG. 4 is a perspective view of the assembled articulated container apparatus.

The container apparatus 10, which is shown in its fully assembled configuration in FIG. 4, is fabricated substantially from a first container member 12, shown in FIG. 1, and a second container member 14, shown in FIG. 2.

In a first embodiment of the invention, first container member 12 is formed from suitable container material, such as triple-wall corrugated paper material, and is formed in three portions, a first bottom wall member 16, side wall member 18, and side wall member 20. Side wall member 18 further includes center section 22, and wings 24 and 26, while side wall member 20 includes center section 28, and wings 30 and 32. First bottom wall member 16 has a substantially octagonal configuration, which is symmetrical about an axis A extending along the direction from side wall member 18 to side wall member 20. Fold lines 34, 36, 38, 40, 42 and 44 are provided to enable side wall members 18 and 20, and their respective wings 24 and 26, and 30 and 32, respectively, to be articulated, as desired, in a manner to be described hereinafter. Wings 24, 26, 30 and 32 are provided with stacking tabs 46–49, and notches 50–53, respectively. In addition, wings 24, 26, 30 and 32 include slots 54–57, to permit visibility and ventilation to the contents when articulable container apparatus is fully assembled and loaded. Center sections 22 and 28 are further provided with tabs 29, and 31, the function of which is described with respect to FIG. 4.

Second container member 14, likewise, is formed from triple-wall corrugated container material, and is formed in three portions, a second bottom wall member 60, side wall member 62, and side wall member 64. Fold lines 66 and 68 enable articulation of side wall members 62 and 64. Second bottom wall member 60 is substantially rectangular in shape, and symmetrical about an axis B, extending parallel to fold lines 66 and 68. Second bottom wall member 60 is provided with stacking slots 70, 72, 74 and 76, which have dimensions substantially corresponding to, but preferably slightly greater than, the width and thickness of stacking tabs 46–49, respectively. Side wall members 62 and 64 also may be provided with apertures 78, similar to apertures 54–59, of first container member 12.

Second container member 14 is configured so that the distance from fold line 66 to fold line 68 on second bottom wall member 60 is slightly greater than the distance from edge 17 to edge 19 on first bottom wall member 16. Likewise, the distance from edge 61 to edge 63 on second bottom wall member 60 is slightly greater than the distance from fold line 36 to fold line 42 on first bottom wall member 16. The widths of wings 24, 26, 30 and 32, respectively, are Slightly less than the lengths of diagonal edges 21, 23, 25 and 27, respectively. The widths of side wall members 62, 64 are substantially equal to the lengths of edges 17, 19 of first container member 12.

Figure 3:
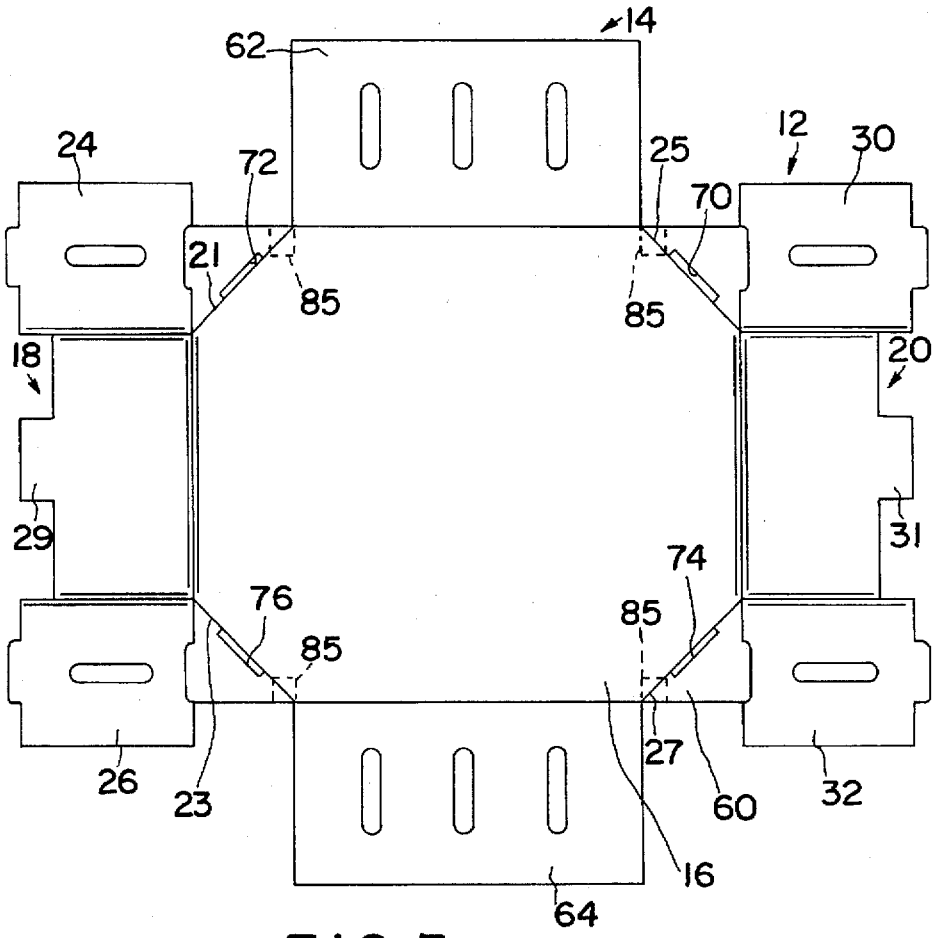
FIG. 3 is a top plan view of the first and second bottom wall members positioned in overlying, unarticulated arrangement relative to one another.

First container member 12 is operably configured to be set atop second container member 14, such that axis A is parallel to, and substantially aligned with, axis B, and first bottom wall member 16 is substantially centered within the periphery of second bottom wall member 60, as shown in FIG. 3. Side wall members 18 and 20 then are folded into substantially. perpendicular relation to first bottom wall 16 (outwardly toward the observer as viewed in FIG. 3). Wings 24, 26, 30 and 32 are then folded inward to align substantially With edges 21, 23, 25, and 27. Side wall members 62 and 64 also then are folded into substantially perpendicular relation to second bottom wall member 60, and an article containment region is substantially defined.

To maintain the several side walls in their upright positions, engagement elements 80 are provided (shown in FIG. 4, and not shown in FIGS. 1–3). Each engagement element 80 includes an engagement member 82 and an engagement member 84, each of which, in a preferred embodiment of the invention, may be formed from a durable plastic, or other suitable strong material. Each engagement member 82 has several lobes 86, with aligned apertures 88 extending therethrough. Likewise, each engagement member 84 has several lobes 90, with aligned apertures 92 extending therethrough. When an engagement member 82 is aligned with an engagement member 84, lobes 86 are interdigitated with lobes 90, and apertures 88 and 92 become concentric. A locking member 94, in the form of an elongated pin, preferably fabricated of stainless steel and having a generally L-shaped configuration, then may be inserted through apertures 88 and 92, to keep engagement member 82 engaged with engagement member 84. Engagement member 84 also may be provided with catch members 95, into which the short end of locking member 94 may be slidingly inserted, preferably with a slightly forced fit, so as to tend to retain locking member 94 in place and prevent its inadvertent displacement.

Engagement members 82 and 84 may be affixed to the edges of the side wall members in any known manner, such as by providing them with resilient gripping members in the form of inwardly projecting pins or teeth, to grasp the opposed flat surfaces of the side wall members. Alternatively, resilient snap rivet members 100 may be passed through the resilient gripping members to assure that the engagement members remain affixed to the side wall members. As a further alternative, the resilient gripping members may be affixed by adhesive to grasp the side wall members.

In use, once an articulable container apparatus 10 is erected, and filled with produce, it can then be stacked on another such apparatus 10. The stacking tabs 46–49 of the lower apparatus 10 will be aligned with and insertingly received by the stacking slots 70, 72, 74 and 76 of the upper apparatus 10, nesting into notches 50–53 of the upper apparatus 10. When properly seated, the stack of apparatus 10 is more stable than a similar stack of simple cartons or crates. At the destination, unloading is accomplished by first unstacking the container apparatus. The spaces adjacent to tabs 29, 31, which are formed when container apparatus 10 are stacked atop one another, may be advantageously configured to accommodate the tines of a forklift, to facilitate unnesting of the container apparatus.

By removing the locking members 94 from consecutive engagement elements 80, on opposite sides of any side wall, that particular side wall is able to be folded down.

Figure 9:
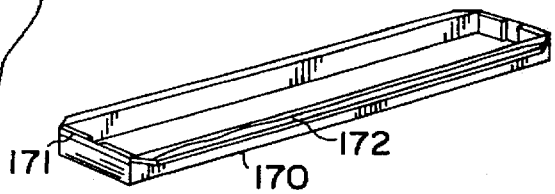
FIG. 9 is a perspective, inverted view of the crossbeam member.

In order to help support container apparatus 10, particularly when multiple container apparatus 10 are stacked atop one another, a crossbeam 170 is provided (see also FIG. 9), which is configured to set atop tabs 29, 31. Crossbeam 170, which may be formed from folded sheet steel or aluminum, helps hold side wall members 18 and 20, toward one another, to resist outward bulging, to which the side wall members would otherwise tend, during stacking of container apparatus 10, particularly filled container apparatus 10. As a safety measure, the edges of crossbeam 170 may have edge trim members 171, 172 provided, to cover any rough, jagged or sharp edges remaining after forming. Edge trim members 171, 172 may be formed from plastic or rubber. The presence of crossbeam 170 is particularly important for the transport of certain produce, such as tomatoes, which emit substantial quantities of moisture, which may tend to infiltrate into even wax-treated corrugated material, making it both heavier and weaker, and less rigid.

As an alternative to crossbeam 170, another support member might be formed as a cap, preferably fabricated from a plastic material, which covers the entire top of container apparatus 10, and has, for example, a downward extending peripheral ledge, so as to engage the tops of the side wall members and wings, to help prevent outward buckling.

The construction of the container apparatus 10 is advantageous for the transport of produce, particularly produce which, for maximum flavor and quality, must be harvested when in a physically delicate condition, such as tomatoes. The triple-wall corrugated material provides strength and rigidity, and still has some yielding resilience or "give". This enables the produce to be picked later, when the flavor and general quality is improved, and thereafter transported with greater security and less damage. The large apertures 54–57 and 78 provide for substantial ventilation to enable the produce to be cooled quickly. As mentioned herein, the side-opening construction improves the speed with which the container apparatus 10 may be emptied, and as well enables the unloading to be less damaging to the produce.

While first bottom wall member 16 of first container member 12 is illustrated as having an octagonal shape, in other embodiments, other shapes, such as a rectangle, may be employed. In an alternative embodiment in which first bottom wall member 16 is a rectangle (not shown), wings 24, 26, 30 and 32 might not be demarcated from center sections 22 and 28 by fold lines, and the lengths of side wall members 18 and 20 could be equal to the lengths of fold lines 36 and 42. Alternatively, center sections 22, 28, could have lengths equal to fold lines 36 and 42, and wings 24, 26, 30 and 32 would be articulable to extend parallel to edges 17 and 19. Side wall members 62 and 64 would then have lengths less than edges 17 and 19.

In the first embodiment of FIGS. 1–4, side wall members 18 and 20 are illustrated as emanating from a first bottom wall member 16 in a first container member 12, and side wall members 62 and 64 are illustrated as emanating from a second bottom wall member 60 in a second container member 14, upon which first container member 12 is juxtaposed. In a second, preferred embodiment of FIGS. 5–10, all side wall members emanate from a single bottom wall member, in a single container member, the bottom wall member of which could be reinforced as desired with the juxtaposition of additional bottom wall members, laid atop the bottom wall member of the single container member.

The alternative embodiment of the invention is shown in FIGS. 5–10, in which an alternative construction of the stacking tabs and stacking slots, and of the engagement elements, is provided. Elements similar or substantially identical to those described with reference to the previous embodiment, are designated with like reference numerals followed by a prime (').

Container member 12' includes first bottom wall member 16', and side wall members 18' and 20' which in turn, include center section 22' and wings 24' and 26', and center section 28' and wings 30' and 32', respectively Container member 12' also includes side wall members 62' and 64'. Container member 12' is provided with fold lines 36', 42', 66' and 68'.

Figure 8B:
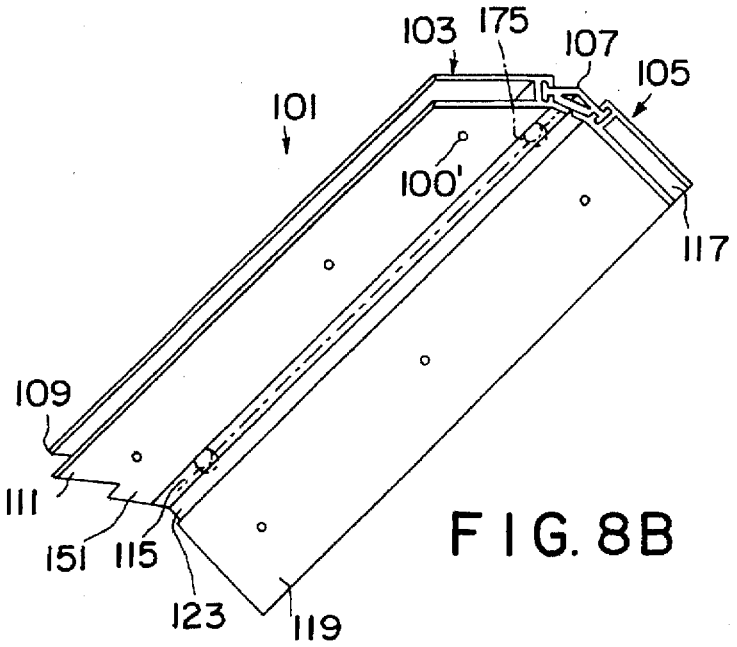
FIG. 8B is a perspective view of the engagement elements, according to the embodiment of FIG. 5, removed from the container member.
Figure 8C:
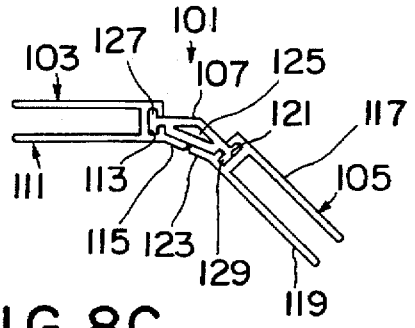
FIG. 8C is a top plan view of the engagement elements, according to FIG. 8B.

Engagement elements 101 (FIGS. 8A, 8B, and 8C) include engagement members 103, 103' and 105, 105' and locking members 107. The cross-sections of engagement members 103, 105 and locking member 107 are indicated in FIG. 8C and are, in the preferred embodiment of the invention, substantially uniform throughout the lengths of the respective elements. It is understood that engagement members 103' and 105' are identical to engagement members 103 and 105, apart from being constructed as mirror-image counterparts thereto. Each engagement member 103 has two substantially rectangular legs 109 and 111, as in the previous embodiment, for surrounding and facilitating affixation to an appropriate side wall member or wing, and may be affixed to the side wall member or wing, in any of the ways previously described, such as by plastic rivets 100'. Each engagement member 103 is also provided with a lengthwise-extending T-shaped slot 113, and an angled rectangular lengthwise-extending tab 115.

Similarly, each engagement member 105 has two substantially rectangular legs 117 and 119, as in the previous embodiment, for surrounding and facilitating affixation to an appropriate side wall member or wing, and may be affixed to the side wall member or wing, in any of the ways previously described. Each engagement member 105 also is provided with a lengthwise-extending T-shaped slot 121, and an angled rectangular lengthwise-extending tab 123.

Locking members 107 each have a substantially pentagonally-shaped core 125, with T-shaped lengthwise-extending splines 127 and 129 emanating from the sides of the core 125. Splines 127 and 129 are configured to be insertingly received by T-shaped slots 113 and 121, preferably with some frictional resistance, so that when inserted, splines 127 and 129 will not work themselves loose as a result of the vibrations and jarring which accompany transport of the container apparatus. In addition, locking members 107, as disclosed hereinafter, rest, in part, on corner shields 141, when locking members 107 are fully inserted. Tabs 115 and 123 are so formed to make angles with corresponding legs 109 and 111, and 117 and 119, so that when the corresponding adjacent wing and side wall member are raised, tabs 115 and 123 are substantially parallel and coplanar with one another, and aligned edge-to-edge. Locking members 107 may also be provided with through-holes 175 (shown in phantom in FIG. 8C), which enable locking members 107 to be easily grasped for removal. In a preferred embodiment of the invention, all of the components of engagement elements 101 are formed from plastic material.

Figure 5:
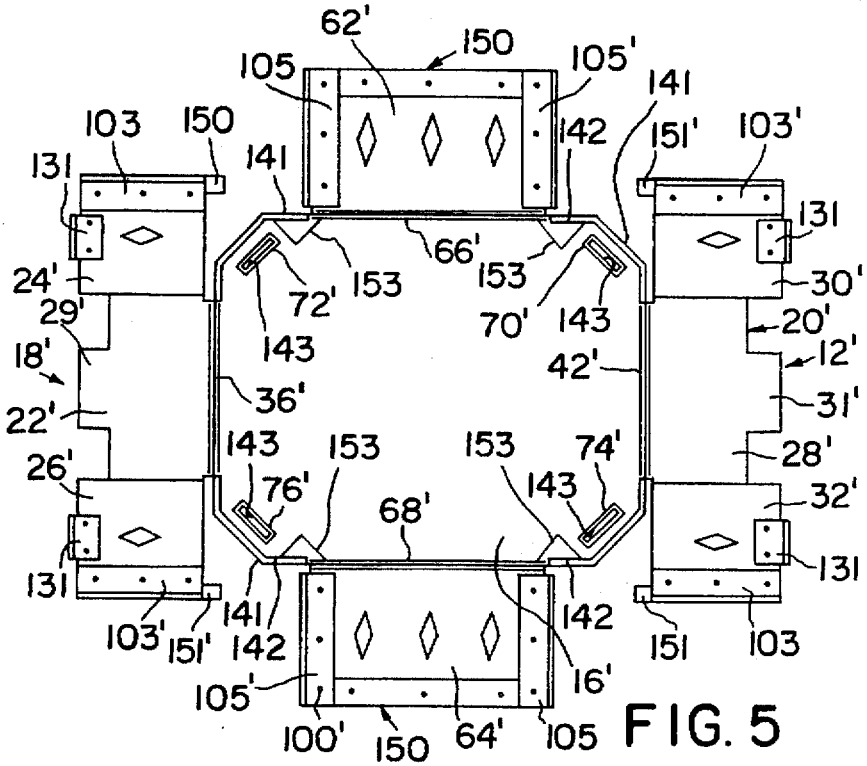
FIG. 5 is a top plan view of an alternative embodiment of the invention.
Figure 6A:
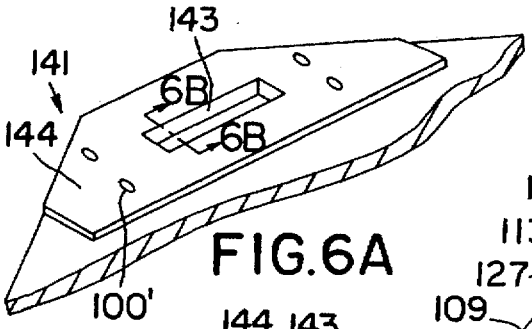
FIG. 6A is a fragmentary perspective view, from below, of a corner of the first bottom wall member, according to the embodiment of FIG. 5.
Figure 6B:
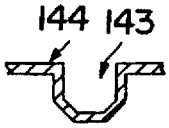
FIG. 6B is a fragmentary side elevation taken along line 6B—6B of FIG. 6A.
Figure 8A:
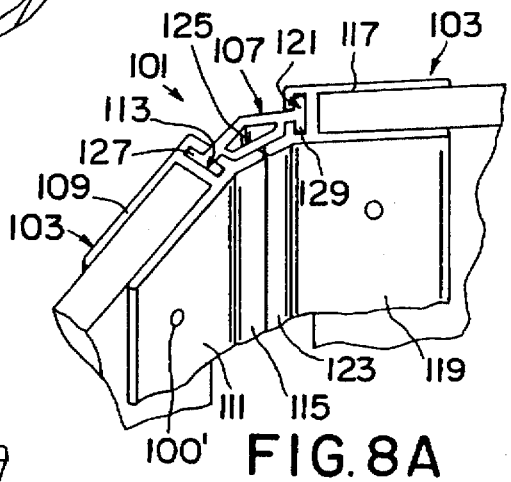
FIG. 8A is a fragmentary perspective view of a portion of the engagement elements, according to the embodiment of FIG. 5.
Figure 10:
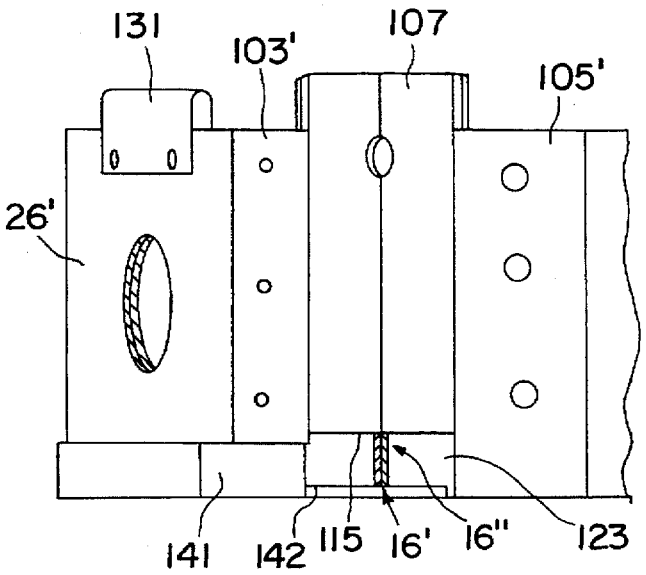
FIG. 10 is a partial side elevation of an assembled, raised container, according to the embodiment of FIG. 5.

In the preferred embodiment of FIGS. 5–10, engagement members 105 are so constructed as to extend substantially the entire vertical height of side walls 62' and 64', as is shown in detail with regard to FIG. 10, which represents a side elevation of the lower left corner of apparatus 10', as shown in FIG. 5, when erected. Locking member 7 is shown raised slightly upward. Bottom wall 16' may be visible in a slight gap between tabs 115 and 123. An additional thickness of container material 16" may be provided to give extra reinforcing strength to the bottom of container apparatus 10'. Engagement members 103, 103' extend substantially the full vertical height of wings 24', 26', 30', and 32'; however, wings 24'–32' do not extend toward fold lines 36', 42', as closely as side walls 62', 64', extend toward fold lines 66', 68', so as to enable wings 24'–32' to swing over corner shields 141, to meet side walls 62', 64'. Engagement members 103, 103' have extension tabs 151, 151', respectively, which extend through cut-outs 153 in container member 12' and/or in any container material set upon container member 12', to rest directly upon corner shields 141. Corner shields 141 are cut out along edges 142, to accommodate extension tabs 151 and 151', and prevent interference with locking members 107 when they are fully lowered. When one apparatus 10' is stacked atop another apparatus 10', engagement members 105, 105' align with and directly rest upon corresponding engagement members 105, 105' of the apparatus 10' immediately below. Likewise, engagement members 103, 103' align with engagment members 103, 103' of the apparatus 10' below (with corner shields 141 between them). This arrangement provides for enhanced stacking strength and stability, by precluding crushing of the container material, to enable several ones of container apparatus 10' to be stacked.

FIGS. 5–10 also show an alternative configuration of the stacking tabs and stacking apertures. In the first discussed embodiment of the invention, the stacking tabs and apertures were formed exclusively from the corrugated material from which the first and second container members were fabricated. As a result of fatigue, rough handling, and extended exposure to moisture, the stacking tabs and apertures can become deformed or torn before the rest of the container apparatus, making it difficult to reliably stack the container apparatus, and thus shortening or limiting the useful life of the container apparatus.

Figure 7:
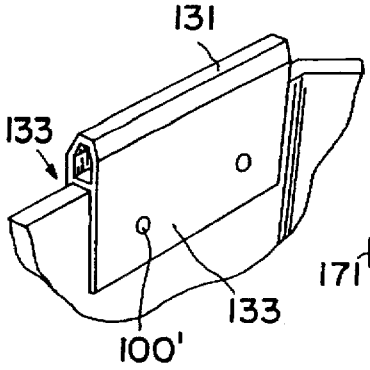
FIG. 7 is a fragmentary perspective view of an attached tab member, according to the embodiment of FIG. 5.

Accordingly, tab members 131 are provided, to cover or substitute for the tab members 46–49 of the previous embodiment. Tab members 131 are preferably formed from plastic material, have rectangular legs 133, and may be attached to wings 24', 26', 30' and 32', in the same manner that the engagement members are attached, as previously described, such as by plastic rivets 100'. As shown in FIG. 7, the top of each tab 131 has a pentagonal cross-section. To complement tab members 131, corner shields 141 (FIGS. 6A, 6B) are provided, which are configured to fit over the lower surfaces of the corners of first bottom wall member 16'. Each corner shield 141 is provided with an aperture insert 143, in the form of a rectangular pocket emanating from the lower flange 144 of aperture insert 143, and is held in place, for example, by plastic rivets 100'. In operation, the corner shields 141 are permanently affixed so that aperture inserts 143 extend upwardly into the apertures 70', 72", 74', and 76' provided in first bottom wall member 16'. As can be observed from FIG. 5 (or FIG. 4 of the previous embodiment), tabs 131 are positioned slightly inward of inserts 143. When assembled container apparatus 10 are stacked atop one another, tabs 131 of one container apparatus are deflected outward, by their inclined upper edges, to align with and be insertingly received by aperture inserts 143 of the container apparatus immediately above. This slightly forced fit helps a stack of container apparatus 10 to maintain its stability. Since inserts 143 are pockets, and not through apertures, the tops of tabs 131 abut the insides of inserts 143, and thus do not project above apertures 70', 72', 74' and 76', so notches 50–53 of the previous embodiment can be omitted.

Additional reinforcement of the container apparatus, as shown in FIGS. 5–10, can be obtained by the provision of reinforcement members 150 along the top edges of side wall members 62' and 64'. In a preferred embodiment of the invention, reinforcement members 150 are fabricated from plastic material.

By constructing the container members from triple-wall corrugated container material, the container apparatus is provided with increased strength and durability, enabling larger volume container apparatus to be constructed. Because the bottom of the container apparatus has, in at least the second embodiment, a total of two thicknesses of triple-wall corrugated material, buckling is reduced, and handling of stacks of several container apparatus at a time, with a forklift or the like, can be accomplished. The container apparatus also benefits from a simplified construction, assembly and operation, which also improve the cost effectiveness of the invention over prior carton constructions. The corrugated material also may be treated, with a suitable coating, such as a wax-like material, in a known manner, so as to be moisture resistant, and to facilitate cleaning between usages.

A further aspect of the invention is that when a container apparatus according to one of the embodiments herein has been used a number of cycles such that the corrugated container material portions are deemed to be no longer strong or rigid enough to satisfactorily perform, the various components fabricated from plastic, such as engagement elements 80, or engagement elements 101, tab members 131, corner shields 141, and reinforcement members 150, may be removed from the corrugated material without deformation or destruction thereto, such as by drilling out or clipping the plastic rivets 100 (100'). The various plastic components may then be positioned on other container apparatus being fabricated new rivet holes drilled, if necessary, and new rivets 100 (100') placed, so that the plastic components may be reused for a number of successive container apparatus.

The use of plastic for the various identified components is preferred over other potential materials, such as aluminum, for example, for a variety of reasons. Plastic components may be fabricated substantially without sharp or ragged edges, unlike metal components which would typically require further working, by filing, grinding or sanding, so as to prevent injury to workers and/or damage to the produce. In addition, some produce, such as tomatoes, are highly acidic, and metal components may tend to destructively or toxically react in the presence of such acidic produce.

In the embodiment of FIGS. 5–10, when all of locking members 107 are pulled, all of the side walls of container apparatus 10' can fall outward, leaving a flat, open container. It is contemplated that fastest filling of the container can be achieved by placing the produce on the flat opened container apparatus 10', and when a sufficient amount for efficient packing has been placed on the open container apparatus 10', the side walls are raised, and locking members 107 fitted in, to keep the side walls upright. It is also contemplated that when it is necessary that empty container apparatus 10' must be shipped, that the side walls are advantageously configured so as to fold inwardly, to a substantially flat configuration, so as to be positionable upon, and in substantial conformance with the dimensions of a standard shipping pallet.

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention.

What is claimed is:

1. An articulable container apparatus for containment and protection of articles, said container apparatus having an upper opening and further being stackable with others of said container apparatus, said container apparatus comprising:

at least one bottom wall member;

first and second side wall members operably associated with said at least one bottom wall member, and articulable from positions substantially coplanar with said at least one bottom wall member to positions perpendicular to said at least one bottom wall member, said first and second side wall members being further arranged upon substantially opposite sides of said at least one bottom wall member;

third and fourth side wall members operably associated with said at least one bottom wall member, and articulable front positions substantially coplanar with said at least one bottom wall member to positions substantially perpendicular to said at least one bottom wall member, said third and fourth side wall members being further arranged upon substantially opposite sides of said at least one bottom wall member, such that said third and fourth side wall members are arranged in alternating positions relative to said first and second side wall members around said at least one bottom wall member;

a plurality of releasable side wall engagement means operably associated with at least three of said first, second, third and fourth side wall members, such that upon said articulation of said first and second and third and fourth side wall members into said substantially perpendicular positions relative to said at least one bottom wall member, said at least one bottom wall member, and said first, second, third and fourth side wall members define and partially enclose an article containment region:

said side wall engagement means positively, yet releasably interlocking together said at least at three of said first, second, third and fourth side wall members, with at least two adjacent ones of said plurality of releasable side wall engagement means each including at least one freely removable member, operably configured to be substantially separable from the articulable container apparatus, to enable the repositioning of at least one of said side wall members positioned therebetween, said at least one of said side wall members being repositionable only upon said substantial separation of said freely removable members from the container apparatus, said at least one bottom wall member and said first, second, third and fourth side wall members all being fabricated from a first material, and said releasable side wall engagement means being fabricated from at least a second material having a strength greater than said first material, such that said releasable side wall engagement means further serve as reinforcement means for said at least three of said first, second, third and fourth side wall members, whereupon release of said at least two adjacent side wall engagement means, by removal of said respective freely removable member from each, at opposite ends of at least one of said first, second, third, and fourth side wall members, enables said side wall member to be articulated from its respective position substantially perpendicular to said at least one bottom wall member to enable access from said respective side to said article containment region, the releasable side wall engagement means further comprising a pair of engagement members operably arranged upon adjacent edges of adjacent ones of said first, second, third and fourth side wall members, respectively, and arrangeable in juxtaposed cooperating relation to one another, when said side wall members are in said substantially perpendicular positions relative to said at least one bottom wall member, said at least one freely removable member further comprising a removable locking member, operably insertable into said engagement members so as to maintain said engagement members in said juxtaposed cooperating relation, to, in turn, maintain said adjacent ones of said first or second, and third or fourth side wall members in said substantially perpendicular positions, said engagement members further including engagement portions, operably disposed on said engagement members so as to be positionable in a substantially interdigitated configuration, when said adjacent ones of said first or second, and third or fourth side wall members are in said substantially perpendicular positions, for enabling said at least one freely removable member to be inserted, in alternating succession through respective ones of said interdigitated engagement portions of adjacent engagement members of adjacent ones of said first or second, and third or fourth side wall members.

2. The articulable container apparatus according to claim 1 wherein said at least one bottom wall member comprises:

one bottom wall member;

said first and second side wall members being operably associated with said one bottom wall member, upon opposite sides thereof, and said third and fourth side wall members likewise being operably associated with said one bottom wall member, upon further opposed sides thereof, in alternating positions with said first and second side wall members, such that upon said articulation of said first, second, third and fourth side wall members, said side wall members define and partially enclose said article containment region.

3. The articulable container apparatus according to claim 2 wherein said first and second side wall members are formed continuously with said one bottom wall member from a single piece of container material.

4. The articulable container apparatus according to claim 2 wherein said third and fourth side wall members are formed contiguously with said one bottom wall member from a single piece of container material.

5. The articulable container apparatus according to claim 1 wherein said at least one bottom wall member comprises:

a first bottom wall member and a second bottom wall member, said first and second side wall members being operably associated with said first bottom wall member, upon opposite sides thereof, and said third and fourth side wall members being operably associated with said second bottom wall member, upon opposite sides thereof, said first and second bottom wall members being positionable into juxtaposed, adjacent, parallel overlying relation to each other, to enable said articulation of said first, second, third and fourth side wall members to define and partially enclose said article containment region.

6. The articulable container apparatus according to claim 5 wherein said first and second side wall members are formed contiguously with said first bottom wall member from a single piece of container material.

7. The articulable container apparatus according to claim 5 wherein said third and fourth side wall members are formed contiguously with said second bottom wall member from a single piece of container material.

8. The articulable container apparatus according to claim 1 wherein each of said releasable side wall engagement means comprises:

a pair of engagement members operably arranged upon adjacent edges of adjacent ones of said first, second, third and fourth side wall members, respectively, and arrangeable in juxtaposed cooperating relation to one another, when said side wall members are in said substantially perpendicular positions relative to said at least one bottom wall member; and said at least one freely removable member comprises a removable locking member, operably insertable into said engagement members so as to maintain said engagement members in said juxtaposed cooperating relation, to, in turn, maintain said adjacent ones of said first or second, and third or fourth side wall members in said substantially perpendicular positions.

9. The articulable container apparatus according to claim 1, further comprising:

means for facilitating stacking of at least one said articulable container apparatus upon another of said articulable container apparatus, in a substantially secured, stabilized manner.

10. The articulable container apparatus according to claim 9, wherein said means for facilitating stacking of said articulable container apparatus comprises:

at least one stacking tab member, operably emanating upwardly from at least one of said first, second, third and fourth side wall members, when said side wall members are in said substantially perpendicular positions; and at least one stacking aperture operably disposed in at least one of said first and second bottom wall members, such that when a first articulable container apparatus is stacked above another, second articulable container apparatus, at least one stacking aperture in said first articulable container apparatus receives a stacking tab member emanating from said second articulable container apparatus.

11. The articulable container apparatus according to claim 10, wherein said at least one stacking tab member comprises a separate tab element, operably and permanently affixable to one of said first, second, third or fourth side wall members.

12. The articulable container apparatus according to claim 11, wherein said at least one stacking tab member is fabricated from plastic material.

13. The articulable container apparatus according to claim 9, further comprising:

at least one shield member, operably positionable upon said at least one bottom wall member, in operable alignment with said at least one stacking aperture, to facilitate protection of said stacking aperture upon receipt of said at least one stacking tab member.

14. The articulable container apparatus according to claim 13, wherein said at least one shield member is fabricated from plastic material.

15. The articulable container apparatus according to claim 1, wherein each of said at least one bottom wall member, and said first, second, third, and fourth side wall members is formed from triple wall corrugated material.

16. The articulable container apparatus according to claim 1, further comprising:

means for resisting outward buckling of opposite ones of said first, second, third and fourth side wall members, when multiple ones of said container apparatus are stacked atop one another and loaded.

17. The articulable container apparatus according to claim 16, wherein said means for resisting outward buckling comprises:

a substantially rigid support member, operably supported by, extending transversely between and connecting opposite ones of at least one pair of said first and second, and third and fourth side wall members.

18. The articulable container apparatus according to claim 1, further comprising:

means for resisting outward buckling of side wall members, operably disposed upon an upper edge of at least one of said first, second, third and fourth side wall members.

19. The articulable container apparatus according to claim 1, wherein said at least one bottom wall member has a substantially octagonal configuration.

20. The articulable container apparatus according to claim 19, further comprising:

wing members operably formed in respective side wall members of at least one corresponding pair of said first and second, and said third and fourth side wall members, said wing members being articulable, when said side wall members are articulated to positions substantially perpendicular to said at least one bottom wall member, from positions substantially coplanar with said respective side wall members, to positions substantially oblique to said respective side wall members, such that said first, second, third and fourth side wall members, and said wing members define and substantially enclose an octagonally shaped region, having a configuration substantially corresponding to said octagonal configuration of said at least one bottom wall member.

21. An articulable container apparatus comprising:

a plurality of side wall members having upper edges, at least one of said side wall members having a first left side edge, a first left side wall portion adjacent said first left side edge, a first right side edge, and a first right side wall portion adjacent said first right side edge, said first left and right side edges being separable from other side wall members, at least one other of said side wall members having a second right side edge and second right side wall portion adjacent said second right side edge, and at least another of said side wall members having a second left side edge and a second left side wall portion adjacent said second left side edge, said first left side edge being adjacent said second right side edge and said first right side edge being adjacent said second left side edge;

a bottom wall member hingedly attached to said side wall members, said side wall members being generally orthogonal to said bottom wall member and at least one of said side wall members being collapsible into the plane of said bottom wall member; and a pair of engagement members joining said at least one of said side wall members to said at least one other of said side wall members and said at least another of said side wall members, and a removable member being slideably received by the engagement members to join the side wall members in a configuration shaping the article container apparatus;

the removable member further comprising a locking member, operable insertable into said engagement members so as to maintain said engagement members in said juxtaposed cooperating relation, to, in turn, maintain said at least one of said side wall members in said joined configuration with said at least another of said side wall members, said engagement members further including engagement portions, operably disposed on said engagement members so as to be positionable in a substantially interdigitated configuration, when said at least one of said side wall members is positioned adjacent to said at least another of said side wall members, for enabling said removable member to be inserted, in alternating succession through respective ones of said interdigitated engagement portions of adjacent engagement members of said adjacent side wall members.

22. The articulable container apparatus of claim 21, wherein said removable member being slidable upwardly away from said bottom wall member of the articulable container apparatus and outwardly from said engagement members to release said at least one of said side wall members so that said at least one of said side wall members can collapse into the plane of said bottom wall member.

23. The articulable container apparatus of claim 22, wherein said removable member has gripping means for gripping said removable member to slide it upwardly from said bottom wall member.

24. The articulable container apparatus of claim 21, further comprising a stacking tab disposed on an upper edge of at least one of said side wall members and at least one slot in said bottom wall member of said articulable container apparatus, and wherein said articulable container apparatus is one of a number of articulable container apparatus having a stacking tab disposed on the upper edge, said articulable container apparatus being stacked on one of said number of articulable container apparatus, said at least one slot receiving the stacking tab of said one of said number of articulable container apparatus.

25. An articulable container apparatus comprising:

a plurality of side wall members having upper edges, at least one of said side wall members having a first left side edge, a first left side wall portion adjacent said first left side edge, a first right edge, and a first right side wall portion adjacent said first right side edge, said first left and right side edges being separable from other side wall members, at least one other of said side wall members having a second right side edge and second right side wall portion adjacent said second right side edge, and at least another of said side wall members having a second left side edge and a second left side wall portion adjacent said second left side edge, said first left side edge being adjacent said second right side edge and said first right side edge being adjacent said second left side edge;

a bottom wall member unitary with said side wall members, said side wall members being bent generally orthogonal to said bottom wall member and at least one of said side wall members being collapsible into the plane of said bottom wall member; and a pair of engagement members joining said at least one of said side wall members to said at least one other of said side wall members and said at least another of said side wall members, and a removable member being slideably received by the articulable container apparatus, the removable member further comprising a locking member, operably insertable into said engagement members so as to maintain said engagement members in said juxtaposed cooperating relation, to, in turn, maintain said at least one of said side wall members in said joined configuration with said at least another of said side wall members, said engagement members further including engagement portions, operably disposed on said engagement members so as to be positionable in a substantially interdigitated configuration, when said at least one of said side wall members is positioned adjacent to said at least another of said side wall members, for enabling said removable member to be inserted, in alternating succession through respective ones of said interdigitated engagement portions of adjacent engagement members of said adjacent side wall members.

26. The articulable container apparatus of claim 25, wherein said removable members of said pair of engagement members are slidable upwardly away from said bottom wall member of the articulable container apparatus and outwardly from said engagement members to release said at least one of said side wall members so that said at least one of said side wall members can collapse into the plane of said bottom wall member.

27. The articulable container apparatus of claim 26, wherein said removable members have gripping means for gripping said removable member to slide said removable member upwardly from said bottom wall member.

28. The articulable container apparatus of claim 25, further comprising a stacking tab disposed on an upper edge of at least one of said side wall members and at least one slot in said bottom wall member of said articulable container apparatus, and wherein said articulable container apparatus is one of a number of articulable container apparatus having a stacking tab disposed on the upper edge, said articulable container apparatus being stacked on one of said number of articulable container apparatus, said at least one slot receiving the stacking tab of said one of said number of articulable container apparatus.

29. The articulable container apparatus of claim 26, wherein said engagement members are disposed between all side wall members so that all side wall members can collapse into said plane of said bottom wall member when all of said removable members are slid from said engagement members.

* * * * *